US005161715A

United States Patent [19]

Giannuzzi

[11] Patent Number: 5,161,715

[45] Date of Patent: Nov. 10, 1992

[54] DOUBLE-BARRELED EPOXY INJECTION GUN

[76] Inventor: Anthony C. Giannuzzi, 59 Dingletown Rd., Greenwich, Conn. 06830

[21] Appl. No.: 674,463

[22] Filed: Mar. 25, 1991

[51] Int. Cl.[5] ..... B65D 35/30; B65D 35/56; B67D 5/00

[52] U.S. Cl. ..... 222/82; 222/95; 222/105; 222/135; 222/145; 222/326

[58] Field of Search ..... 222/80-82, 222/87-89, 94, 95, 105-107, 134, 135, 145, 275, 276, 323, 325-327

[56] References Cited

U.S. PATENT DOCUMENTS

| | | | |
|---|---|---|---|
| 1,965,271 | 7/1934 | Wharton | 222/95 |
| 2,090,644 | 8/1937 | Seeberger | 222/323 |
| 2,105,039 | 1/1938 | Hulme | 222/327 X |
| 2,131,487 | 9/1938 | Tear | 222/327 X |
| 2,139,143 | 12/1938 | Wiswell | 222/87 X |
| 2,421,711 | 6/1947 | Moots et al. | 222/327 X |
| 2,733,836 | 2/1956 | Switzer | 222/82 |
| 3,077,078 | 2/1963 | Hamilton | 222/82 |
| 3,117,696 | 1/1964 | Herman et al. | 222/325 X |
| 3,130,872 | 4/1964 | Myers et al. | 222/82 |
| 3,193,146 | 7/1965 | Isgriggs et al. | 222/82 |
| 3,302,832 | 2/1967 | Hardman et al. | 222/145 X |
| 3,323,682 | 6/1967 | Creighton, Jr. et al. | 222/94 |
| 3,504,826 | 4/1970 | Carlton | 222/327 |
| 3,595,448 | 7/1971 | Carlton | 222/327 |
| 3,767,085 | 10/1973 | Cannon et al. | 222/82 |
| 4,067,479 | 1/1978 | Moline | 222/94 |
| 4,136,801 | 1/1979 | Pavenick | 222/82 |
| 4,260,076 | 4/1981 | Bergman | 222/327 X |
| 4,986,443 | 1/1991 | Saur et al. | 222/82 X |
| 4,986,444 | 1/1991 | Corso | 222/95 X |

FOREIGN PATENT DOCUMENTS

| | | | |
|---|---|---|---|
| 0572665 | 10/1945 | United Kingdom | 222/135 |
| 1205210 | 9/1970 | United Kingdom | 222/94 |
| 2088998 | 6/1982 | United Kingdom | 222/95 |
| 2090336 | 7/1982 | United Kingdom | 222/95 |

*Primary Examiner*—H. Grant Skaggs
*Assistant Examiner*—Edward M. Wacyra
*Attorney, Agent, or Firm*—Michael Ebert

[57] ABSTRACT

A double-barreled gun adapted to inject a two component epoxy into a hole to anchor a hardware element therein. The base resin and hardener components of the epoxy are stored in separate foil packs received in parallel barrels of the gun. The gun includes a removable mixing manifold having a pair of end caps which fit into the leading ends of the barrels and are joined to a manifold pipe to whose outlet is attachable a mixing nozzle. Mounted within the rear of each cap across a port therein is a cutting element. Slidable in each barrel behind the pack is a piston whose rod extends from the trailing end of the barrel. An operating mechanism effects concurrent advance of the pistons to an extent limited by a retractable stop member. In an injection mode of gun operation, the advancing pistons force the front ends of the packs against the cutting elements to slit open the packs, the advancing pistons then acting to extrude the components from the packs into the manifold from which the components pass into the mixing nozzle from which the epoxy is discharged. In this mode, the stop member limits advance of the pistons to a stop point short of the cutting elements, at which point the packs are in a crushed state. In an ejection mode, the manifold is removed and the stop member is retracted to permit the pistons to advance beyond the stop point and thereby eject the crushed packs from the barrels.

18 Claims, 5 Drawing Sheets 14
45
46
15
17
16
16A
19
49
47
13
18
12
41
10
20
39
28
26
23
25
32
35
36

19
49
17
16A
47

DOUBLE-BARRELED EPOXY INJECTION GUN

BACKGROUND OF INVENTION

1. Field of Invention

This invention relates generally to gun-type dispensers for discharging a viscous fluid or paste, such as a sealing or bonding agent, from a container storing this agent, and in particular to a double-barreled epoxy injection gun in which the two components of the epoxy are stored in separate foil packs that are loaded into the parallel barrels of the gun, the gun functioning to slit open the packs to permit extrusion and intermingling of the components to form the epoxy.

2. Status of Prior Art

Caulking is a putty-like plastic compound used for filling joints between masonry and other building materials, and for sealing cracks around window frames and wood and metal elements built into masonry joints. Caulking is usually applied by extruding it from a caulking gun to form a bead along the joint.

Caulking compounds and other pastes and viscous fluids which are to be dispensed from a gun are normally stored in a rigid cylinder having a sealed spout projecting from its forward end, the base of the cylinder being defined by a plunger. After the sealed spout is cut open, the plunger is advanced to subject the contents of the container to pressure, thereby causing the viscous fluid or paste to be extruded from the open spout.

Since it is necessary by means of a razor or scissor to cut open the spout, the viscous fluid in the container may then leak from the open spout and soil the hands of the operator as well as otherwise clean surfaces.

In order to provide a grease-dispensing gun adapted to be refilled and operated without soiling the hands of the operator, the Switzer patent, U.S. Pat. No. 2,733,836, discloses a gun whose barrel is loaded with a sealed cylindrical cartridge containing grease. The Switzer gun includes at its forward end a piercing point that when the cartridge is subjected to pressure by a hand-operated plunger, punctures an opening in the cartridge.

In the Meyers et al. U.S. Pat. No. 3,130,872, the dispensing gun is adapted to discharge oils and other viscous fluid contained in sealed metal cans, and for this purpose, a spout is mounted on the front end of the gun, the spout having at its rear end a piercing point. When the can is pressed thereagainst by a hand-operated ram, the point punctures an opening therein into which the spout is inserted, so that the oil contends of the can may now be discharged.

In the dispensing gun shown in the Isgriggs et al. U.S. Pat. No. 3,193,146, a sealed can containing oil is loaded into the barrel of the gun whose forward end is provided with a slidable tap terminating in a piercing point. A removable plug received in the tap is struck a blow to cause the can to be pierced, after which the plug is removed to permit flow of the oil from the tap when pressure is applied to the can.

The concern of the present invention is not limited to gun-type dispensers for single component viscous fluids or pastes, for a need also exists for dispensers of two-component compounds such as an epoxy bonding agent in which one component is an epoxy resin and the other a hardener therefor. Separate packages are required for the components which are only intermixed when the epoxy is to be applied to a site to be bonded.

A problem which arises when the two components of an epoxy bonding agent are contained in separate squeeze tubes each having a sealed spout, is that if the same razor or other cutter is used to cut open both spouts, then the surface of the cutter may become smeared with both components which will interact and bond to this surface.

The Creighton et al. U.S. Pat. No. 3,323,682 discloses a gun-type dispenser in which two cartridges separately storing the resin and catalyst or hardener components of an epoxy bonding agent are concurrently subjected to pressure to extrude these components from the cartridges. As pointed out in this patent, should the resin and hardener components be accidentally mixed together in advance of their intended use, curing will then take place prematurely in a relatively short time, and the resultant epoxy would not be usable. It is essential, therefore, that the epoxy components be stored in separate sealed containers.

In the present invention, the viscous fluid paste to be dispensed is stored in a squeezable sealed pouch. Of prior art interest in regard to a pouch of this type is the Wainberg U.S. Pat. No. 4,265,372, in which oil or other viscous fluid is contained in a pouch formed of synthetic plastic material. This pouch is loaded into a dispenser-cutter which includes a blade that punctures a hole in the pouch which is then subjected to pressure to discharge the contents from the hole.

If one were to load a pouch of the Wainberg et al. type into the barrel of a dispensing gun and pierce an opening in the front end of the pouch, then when the pouch is subjected to pressure to extrude its contents, this will result in an exhausted pouch in a collapsed state at the front end of the barrel. And because the pouch in this state is crushed or crumpled, it is then more or less frictionally stuck within the barrel.

Yet in order to reload the barrel it is necessary to first pull out the crushed pouch therefrom. If an operator seeks to use his fingers for this purpose, he will not only experience difficulty in doing so, but he is likely to soil his fingers, for the surface of the collapsed pouch surrounding its pierced opening is smeared with the constituent it contained. Should he instead use a tweezer or other tool to extract the collapsed pouch from the barrel, the tool will become smeared. And if the gun has a pair of barrels, one for each component of an epoxy resin, since these components interact quickly, should the tool be smeared with both components, an epoxy will form and harden on the surface of the tool which will then be difficult to clean.

Also of prior art interest is the patent to Cannon et al., U.S. Pat. No. 3,767,085, showing a double barrel syringe having a common mixing chamber. Received in the barrels are cartridges containing the two constituents to be mixed, each cartridge having a rear plug which is engaged by a piston. The rods of the two pistons are joined by a common handle for concurrent advance of the pistons.

SUMMARY OF INVENTION

The main object of this invention is to provide a gun-type dispenser having a barrel adapted to accommodate a sausage-like squeezable pouch or foil pack storing a viscous fluid or paste such as a bonding agent, which dispenser, when actuated, functioning to first pierce an opening in the pouch through which its contents are then extruded.

A significant advantage of the invention is that the pouch or foil pack is sealed and leakproof and therefore suitable for long term storage of its contents. The pouch is not punctured until after it is loaded into the barrel of the dispensing gun and the gun then actuated, thereby avoiding soiling the hands of the operator and also obviating the need to cut open the pouch before it is loaded into the dispensing gun.

More particularly, an object of this invention is to provide a double-barreled dispensing gun in which each foil-pack loaded barrel has fitted into its leading end a detachable cap having at its rear a cutting element which is mounted across a port in the cap, the element acting when the pack is pressed thereagainst, to pierce an opening in the front end of the pack.

Also an object of this invention is to provide a gel or paste-dispensing gun whose barrel is loaded with a foil pack behind which is a slidable piston, the gun being operable in an injection mode in which as the piston advances it first acts to force the pack against a cutting blade in the rear of an end cap fitting into the leading end of the barrel to slit open the pack, and as the piston continues to advance, it then acts to extrude the paste through a port in the cap until the pack is exhausted and in a crushed state, the gun being thereafter operable in an ejection mode in which the cap is removed and further advance of the piston acts to eject the crushed pack from the barrel.

Yet another object of the invention is to provide a double-barreled dispensing gun whose parallel barrels are loaded with sealed foil packs storing the two components of an epoxy resin bonding agent, the barrels being coupled at their leading ends to a manifold to which a mixing nozzle is attachable, whereby the components extruded from the cut-open packs are fed into the mixing nozzle and are intermingled before being discharged.

Briefly stated, these objects are attained in a double-barreled gun adapted to inject a two component epoxy into a hole to anchor a hardware element therein. The base resin and hardener components of the epoxy are stored in separate foil packs received in the parallel barrels of the gun. The gun includes a removable mixing manifold having a pair of end caps which fit into the leading ends of the barrels and are joined to a manifold pipe to whose outlet is attachable a mixing nozzle. Mounted within the rear of each cap across a port therein is a cutting element. Slidable in each barrel behind the pack is a piston whose rod extends from the trailing end of the barrel.

An operating mechanism effects concurrent advance of the pistons to an extent limited by a retractable stop member. In an injection mode of gun operation, the advancing pistons force the packs against the cutting elements to slit open the front ends of the packs, these advancing pistons then acting to extrude the components from the packs into the manifold from which the components pass into the mixing nozzle from which the epoxy is discharged. In this mode, a stop member limits advance of the piston to a stop point short of the cutting elements, at which point the packs are in a crushed state. In an injection mode, the manifold assembly is removed to expose the leading ends of the barrels and the stop member is then retracted to permit the pistons to advance beyond the stop point to eject the crushed packs from the barrels.

BRIEF DESCRIPTION OF DRAWINGS

For a better understanding of the invention as well as other objects and further features thereof, reference is made to the following detailed description to be read in conjunction with the accompanying drawings, wherein:

FIG. 11 illustrates another modification of the end cap.

DESCRIPTION OF INVENTION

The Epoxy

Figure 1:
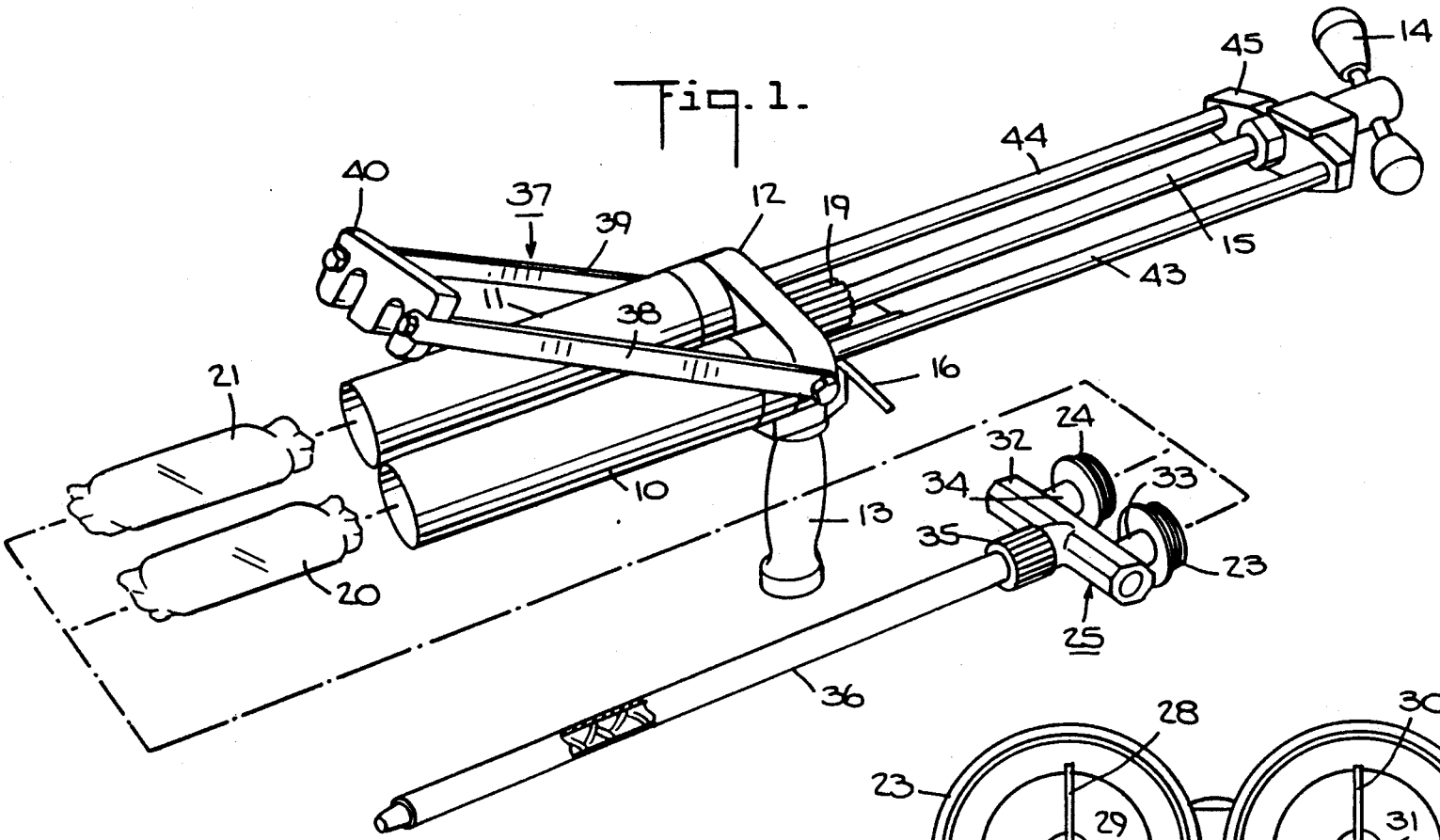
FIG. 1 is an exploded view of a double-barreled epoxy injection gun in accordance with the invention, the swing gate of which is raised to admit foil packs into the barrels.

The purpose of an epoxy injection double-barreled gun in accordance with the invention is to inject a two-component structural epoxy into a hole formed in a substrate. The epoxy serves to anchor a threaded rod, a bolt, a reinforcing bar, a dowel or any other hardware element therein. The substrate may be solid concrete block, brick or stone, or any other form of masonry. In the case of hollow masonry, the epoxy can be used to secure a screen tube in the masonry hole, and then to anchor a hardware element within the screen tube.

The epoxy to be injected into the hole is constituted by a base resin component and a fast set or slow set hardener. The components are mixed in a 1 to 1 ratio to form the epoxy. These components are stored in sealed sausage-like, squeezable pouches or foil packs whose dimensions are such that they can be slidably received in the parallel barrels of the gun.

The foil packs are preferably color coded for easy identification. Because of the 1 to 1 ratio, the foil packs are of the same size.

The Gun Structure

As shown in FIGS. 1 to 4, a gun in accordance with the invention includes a pair of cylindrical barrels 10 and 11, preferably fabricated of aluminum, the barrels being in parallel relation. The trailing ends of the barrels are attached to a cast metal stock piece 12 having a grip 13 integral therewith. This grip is grasped by one hand of an operator whose other hand engages a crank handle 14 at the rear end of a lead screw 15. Screw 15 is included in the operating mechanism of the gun which is provided adjacent the grip with a trigger 16 and a retractable stop member 17. Thus the hand grasping the grip can manipulate the trigger with the thumb. The front end of lead screw 15 is received in a bearing 18 socketed in stock piece 12. Keyed to lead screw 15 adjacent bearing 18 is a ratchet wheel 19.

The function of stop member 17 when this member is in place is to cause the gun to then operate in an injection mode in which the components in the foil-pack loaded barrels are extruded and then intermixed to form the epoxy. When the stop member is retracted, the gun is then operable in an ejection mode in which the foil packs, then in an exhausted and crushed state, are ejected from the barrels of the gun.

Figure 2:
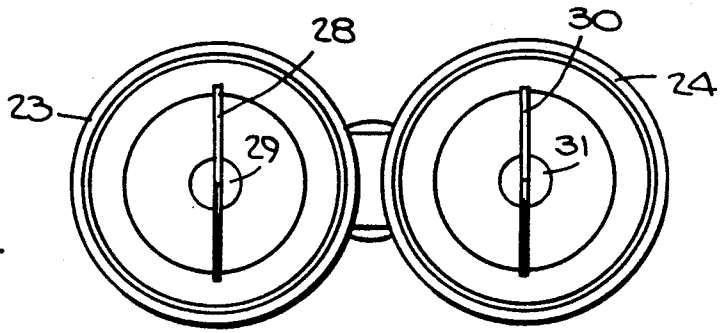
FIG. 2 is a rear view of the manifold caps showing the cutting blades mounted therein.
Figure 4:
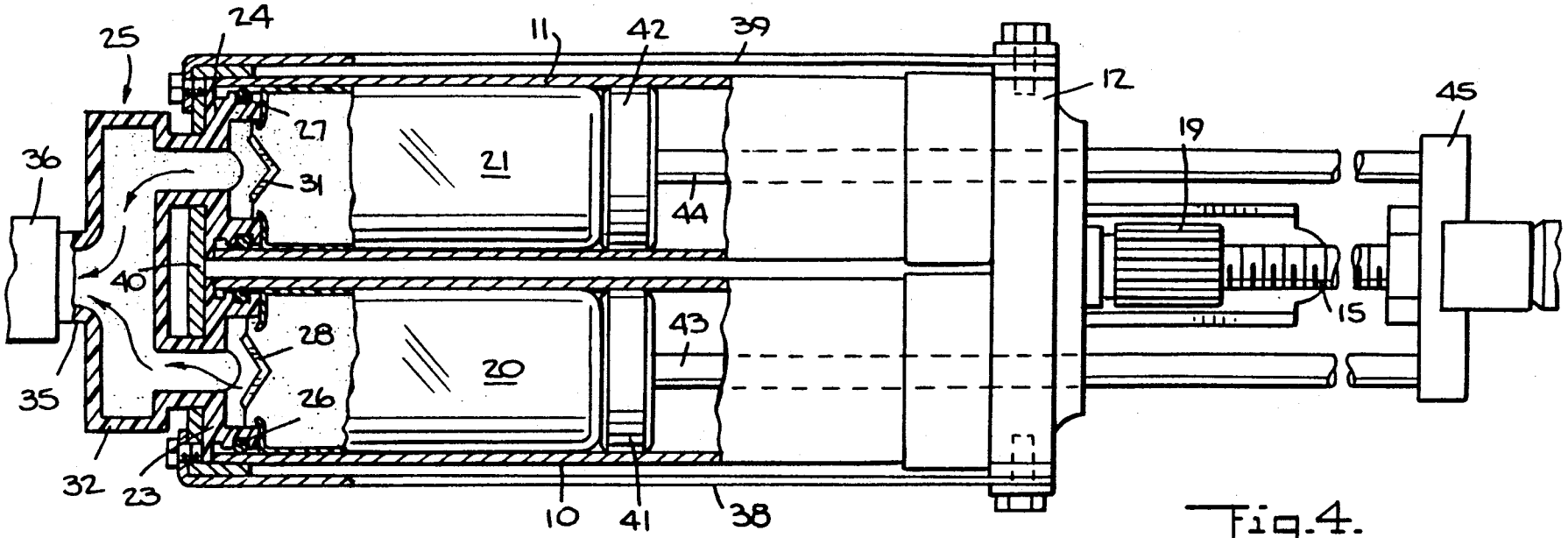
FIG. 4 is a longitudinal section taken through both barrels of the gun in the horizontal plane, the gun being then operative in its injection mode.
Figure 5:
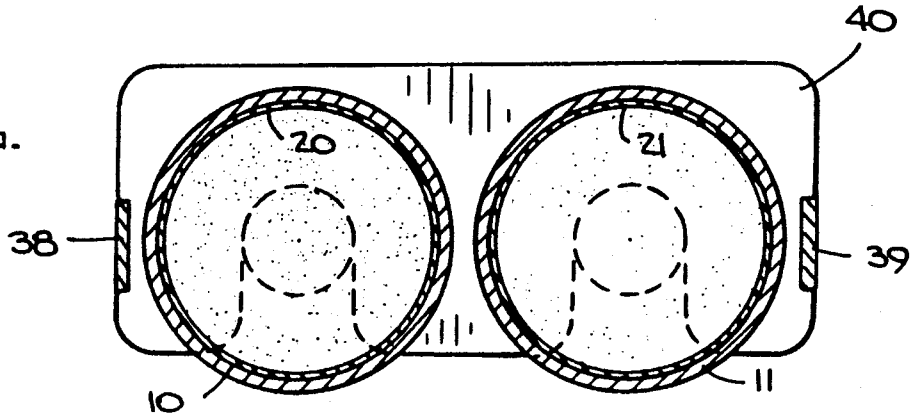
FIG. 5 is a transverse section taken through FIG. 4.

Slidably received through the leading ends of barrels 10 and 11 are sealed foil packs 20 and 21 having stored therein the two components of the epoxy to be injected. Fitting into the leading ends of barrels 10 and 11 are the end caps 23 and 24 of a mixing manifold 25 which, as best seen in FIG. 4, are provided with elastomeric O-rings 26 and 27. Mounted within a well in the rear of each cap, as shown in FIG. 2, is a metal cutting blade having a triangular profile, blade 28 being disposed across a central port 29 in cap 23 and blade 30 across a central port 31 in cap 24. The blades function to slit open the foil packs so that when the packs are squeezed or compressed, the components are extruded therefrom to pass through the ports of the cap.

Manifold 25 includes a manifold pipe 32 communicating through stub pipes 33 and 34 with ports 29 and 31 in the caps. Manifold pipe 32 is provided at its midpoint with a projecting outlet or nipple 35. Nipple 35 is externally threaded to receive an elongated mixing nozzle 36 having a circuitous passage therein to effect mixing of the components passing through the nozzle.

In the injection mode, the gun is operate to slit open the front end of foil packs 20 and 21 loaded in the barrels and to extrude the gel-like components therefrom. As shown by the arrows in FIG. 4, the gels are forced into manifold pipe 32 and discharged through nipple 35 into mixing nozzle 36. The components are intermingled in the nozzle to form the epoxy which is then discharged.

Manifold 25, which is removable from the barrel, is locked in place by means of a swing gate 37 (see FIG. 1) having a pair of parallel arms 38 and 39 whose rear ends are pivotally connected to opposite sides of stock piece 12. Secured to the front ends of these arms is a gate 40 which when the swing is lowered, as shown in FIG. 4, engages the exposed faces of caps 23 and 24. When the swing gate is thereafter raised, one may then withdraw the manifold 25 from the barrels.

Figures 3, 8:
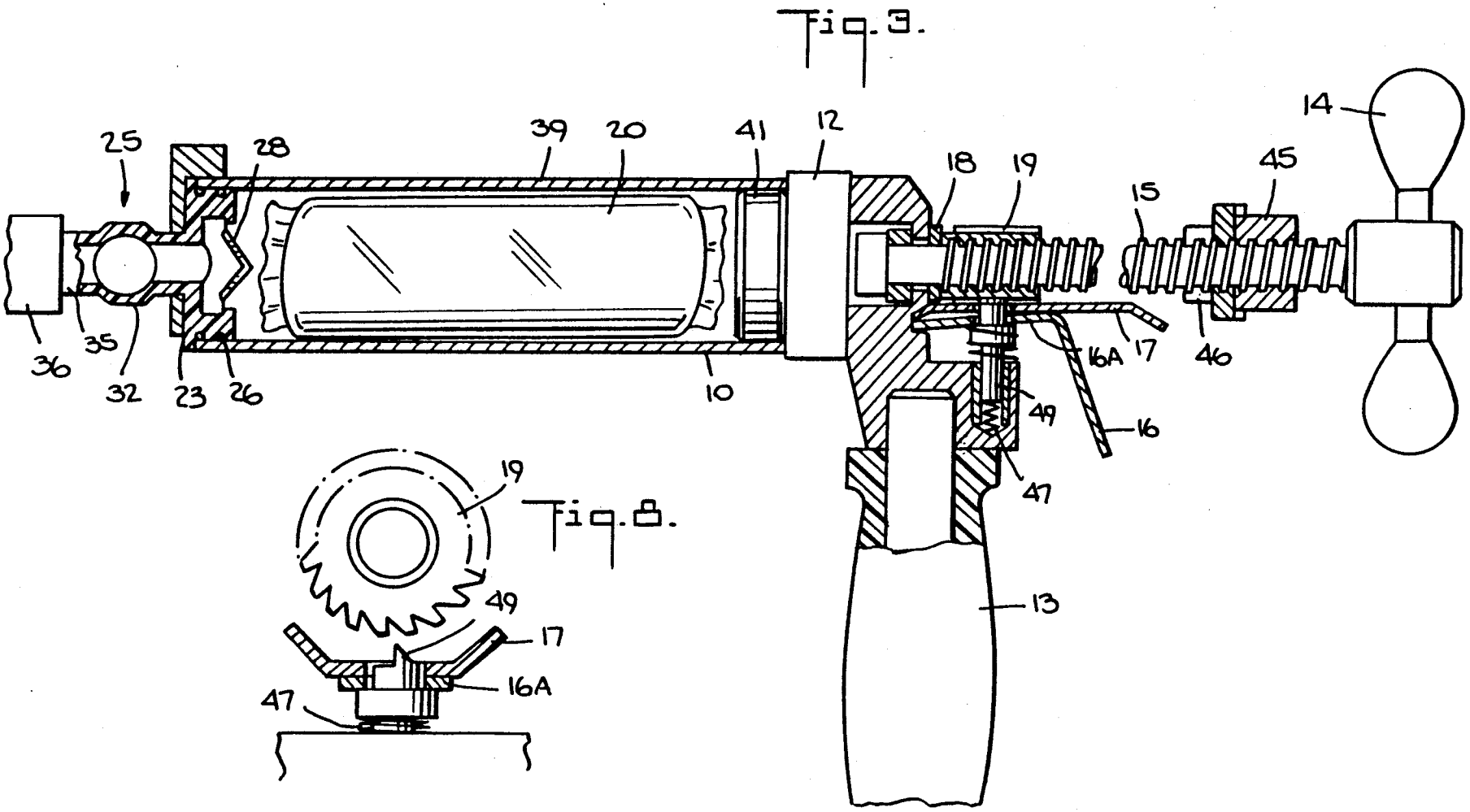
FIG. 3 is a longitudinal section taken in the vertical plane through one of the barrels, the swing gate being lowered to lock the manifold in place, the gun being then operative in its injection mode.
FIG. 8 is the same as FIG. 7, but with the pawl retracted.

As shown in FIGS. 3 and 4, slidable in barrels 10 and 11 behind foil packs 20 and 21 are pistons 41 and 42. Pistons 41 and 42 are provided with piston rods 43 and 44 which extend from the trailing ends of barrels 10 and 11 through journals in stock piece 12 and terminate in a cross piece 45 bridging the rods.

The operating mechanism for the gun, which includes lead screw 15, acts to effect concurrent movement of pistons 41 and 42 to advance or retract the pistons. Lead screw 15 passes through a ball nut 46 mounted on cross piece 45 at a position intermediate piston rods 43 and 44. The nut is provided with ball bearings that are nested in the helical track of the screw and act to reduce friction between the screw and the nut.

When an operator grasping grip 13 in one hand and crank handle 14 in the other hand, turns screw 15 clockwise, this causes the pistons to concurrently advance in the barrels of the gun. When screw 15 is turned counterclockwise, the pistons are then retracted.

Figures 6, 7:
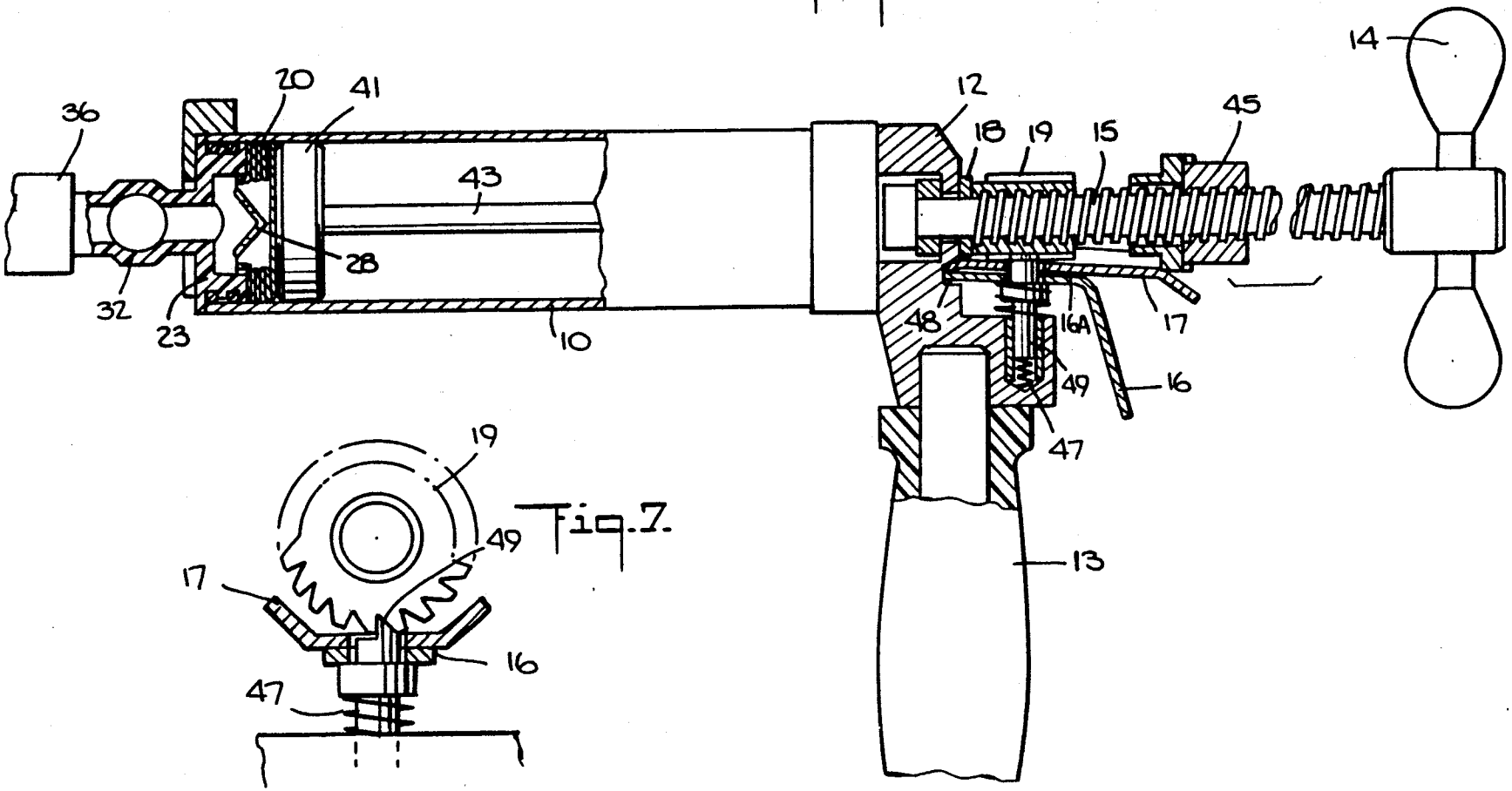
FIG. 6 is a longitudinal section taken in the vertical plane through one barrel of the gun, showing the gun at the conclusion of its injection mode of operation, the foil pack now being in a crushed state.
FIG. 7 is a transverse section taken through the trigger and stop member sub-assembly of the gun, the ratchet pawl being shown in its operative position.

As shown in FIGS. 6, 7 and 8, trigger 16 has a flat, horizontal portion 16A and a downwardly inclined finger portion. Stop member 17 overlies the flat portion of trigger 16. A pawl 49, whose lower end is slidably received in a hole in a shoulder 12S on stock piece 12, extends upwardly through openings in trigger 16 and plate-like stop member 17 to engage the teeth of ratchet wheel 19. The trigger is biased by a helical spring 47 surrounding the pawl, the spring being interposed between the undersurface of flat portion 16A of trigger 16 and the shoulder on stock piece 12.

The front ends of trigger 16 and stop member 17 fit loosely in a notch 48 formed in stock piece 12 so that they are free to swing downwardly. When trigger 16 is actuated by a finger of the operator whose hand grasps grip 13, trigger 16 and stop member 17 then swing down against the pressure of spring 47. In doing so, pawl 49 is disengaged from the teeth of ratchet wheel 19. Thus FIG. 7 shows pawl 49 in engagement with the teeth of the wheel, and FIG. 8 shows the pawl retracted.

When pawl 49 engages the teeth of ratchet wheel 19 keyed to lead screw 15, it then permits unidirectional clockwise motion of the screw to advance cross piece 45 and thereby cause concurrent advance of the pistons in the barrels of the gun. Counterclockwise motion is then prevented by the ratchet. However, when pawl 49 is disengaged from the ratchet wheel, then screw 15 can be turned counterclockwise to retract the pistons. Before the barrels can be loaded with the foil packs, the pistons must be retracted to make room for the packs.

Operation of The Gun

In the injection mode of gun operation, as shown in FIG. 4, barrels 10 and 11 are loaded with sealed foil packs 20 and 21, and caps 23 and 24 of the manifold 25 are fitted into the leading ends of the barrels and are locked in place by gate 40 of the swing gate which is now closed. Trigger 16 is unactuated; hence stop member 17 is in place.

In this mode of operation, crank handle 14 is turned clockwise by the operator, thereby causing both pistons to advance, and in doing so to force the front ends of the squeezable foil packs against cutting blades 28 and 30 in the rear of the caps. As a consequence, the front ends of the packs are slit open. Further advance of the pistons acts to compress the foil packs and bring about extrusion of the epoxy components from the packs into mixing manifold 25 where the components are intermingled and discharged as an epoxy from nozzle 36. The nozzle injects the epoxy into a substrate hole or wherever else the epoxy is to be applied as a bonding agent. As the pistons continue to advance, the foil packs proceed to collapse, and when the packs are fully exhausted they are in a crushed state in the space between the caps and the pistons.

As shown in FIG. 6, stop member 17, which is in place in the injection mode of operation, acts to limit the advance of the pistons; for when cross piece 45 reaches and abuts the rear end of the plate-like stop member, no further advance of the pistons is then possible. The arrangement is such that the stop point of the pistons falls short of the cutting blades 28 and 30 to create a narrow accumulation space therebetween, so that the blades are not struck or injured by the pistons. The crushed and exhausted foil packs 20 and 21 then lie within this narrow accumulation space at the conclusion of the injection mode of operation.

Figures 9, 10:
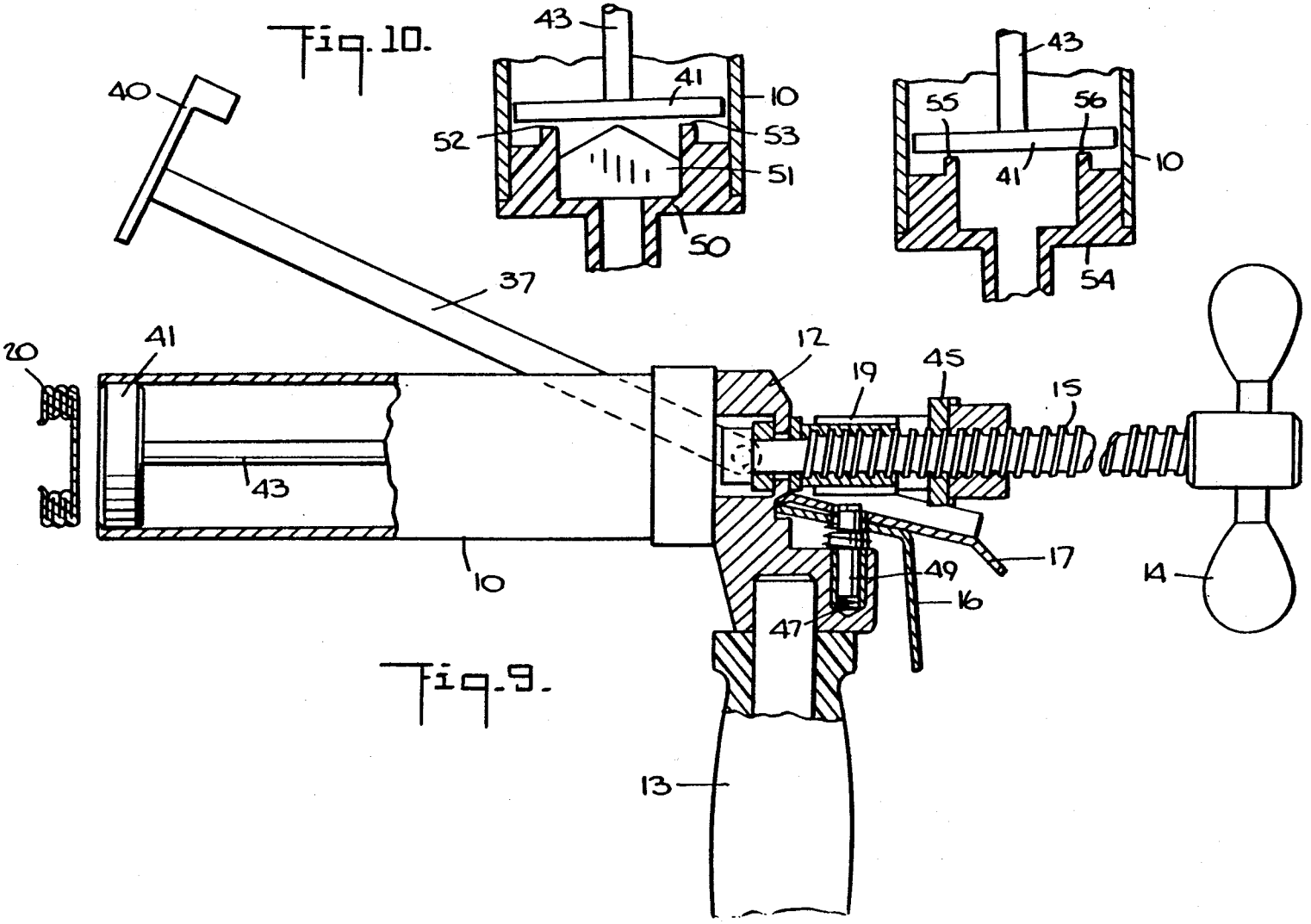
FIG. 9 is the same as FIG. 6, except now the swing gate is raised, the manifold is removed and the gun, which is now in its ejection mode, acts to eject the crushed foil pack from the barrel.
FIG. 10 shows in section one preferred modification of the end cap.

In order now to eject the crushed and exhausted foil packs from the barrels of the gun so that these barrels may be reloaded with fresh packs, the gun is then operated in its ejection mode, which is illustrated in FIG. 9. In this mode, swing gate 37 is lifted to unlock manifold 25 which is then removed from the gun barrels, thereby exposing the crushed, exhausted foil packs.

Trigger 16 is then actuated, this action causing retraction of stop member 17, so that it now becomes possible to further advance the pistons to the leading end of the barrels, and in doing so to eject the crushed packs therefrom.

The advantage of such foil pack ejection is that the operator need at no time touch the exhausted packs or use a tool of some sort to remove them from the barrels. Ejection takes place simply by a further advance of the pistons without soiling the hands of the operator or contaminating a pack-removing tool, or for that matter, the barrels of the gun.

While there has been disclosed a double-barreled gun, the invention is also applicable to a single barrel gun having the same features as a double-barreled gun; that is, a removable cap provided with a cutting blade or other means to slit open or penetrate the foil pack loaded in the barrel, and a retractable stop member which when the member and the cap are in place then operates in an injection mode, and when the cap is removed and the stop member is retracted, then operates in an ejection mode.

Modifications

In the gun shown in FIGS. 1 to 9, the element or means by which a foil pack is slit open is constituted by a cutting blade. However, the invention is not limited to a cutting blade for this purpose, for the element may take the form of a spike, a post, or any other means capable of bursting, puncturing or slicing to create an opening in the foil pack when the pack is pressed against the element by the advancing piston.

And while a retractable stop member is provided to prevent the advancing piston from striking and possibly damaging the cutting element when the gun is operated in its injection mode, the stop means may be incorporated in the removable cap of the manifold rather than being combined with the trigger. Thus in the embodiment of the removable manifold shown in FIG. 10, the cap 50 which is fitted into the leading end of barrel 10 is provided at its rear with a triangular cutting blade 51 which is extended across the port in the cap.

Surrounding blade 51 is an opposing pair of arcuate ledges 52 and 53 whose height somewhat exceeds that of the apex of the triangular blade 51, the curvature of the ledges conforming to that of barrel 10. Hence the advance of piston 41 in barrel 10 is arrested when the piston abuts ledges 52 and 52. The piston cannot therefore strike the apex of the blade.

However, since piston 41 is behind the foil pack loaded into the barrel and the foil pack is subjected to pressure by the advancing piston, the front end of the pack is forced against arcuate ledges 52 and 52. The piston pressure exerted on the pack causes the central zone at the front end of the pack which is bordered by the ledges to bulge out. This bulge, which projects into the cap region encompassed by the ledges, is pierced by the apex of blade 51 which lies within this region, thereby slitting open the pack and causing extrusion of its contents as the piston continues to advance.

When the foil pack is in its crushed state, it then occupies the region surrounding ledges 52 and 52 as well as the inner cap region encompassed by the ledges. In the ejection mode of the gun, when cap 50 is removed, this acts to also remove ledges 52 and 52 which function as the stop member; hence now piston 41 is free to advance to the end of barrel 10 and thereby eject the crushed foil pack.

In the cap arrangement shown in FIG. 11, a separate cutting blade is omitted, for cap 54, which is fitted into gun barrel 10, is provided at its rear with a well bordered by a pair of opposing prongs 55 and 56. These prongs act as stops to limit the advance of piston 41, and also as puncturing means. Thus when the foil pack is pressed against the prongs by the piston, the prongs then penetrate the foil to produce openings in the pack from which the gel is extruded as the piston continues to advance during the injection mode of operation. In the ejection mode, the cap is removed from the barrel and the piston permitted to advance to the end of the barrel to eject the crushed pack therefrom. In practice, a circular array of prongs may be provided rather than a pair thereof.

While there has been shown and described a preferred embodiment of a double-barreled epoxy injection gun in accordance with the invention, it will be appreciated that many changes and modifications may be made therein without, however, departing from the essential spirit thereof.

I claim:

1. A gun for dispensing a viscous agent stored in a sealed, sausage-like foil pouch, said gun comprising:

(a) a barrel having a leading end and a trailing end loadable with the pouch through said leading end;

(b) a removable cap fitting the leading end of the barrel and having a port therein, and foil opening means cooperating with the cap;

(c) a piston slidable in the barrel behind the pouch, said piston being provided with a rod extending from the trailing end of the barrel; and (d) an operating mechanism coupled to said piston rod, said mechanism in an injection mode of operation in which the cap is in place acting to first advance the piston to force the pouch against the foil opening means to create an opening in said pouch, continued advance of the piston then acting to extrude the agent from the pouch through said cap port, said operating mechanism including a stop member which in said injection mode of the gun acts to limit piston advance to a stop point short of the foil opening means, whereby the pouch is then in a crushed state, said operating mechanism in an ejection mode of operation in which said cap is removed and said stop member is withdrawn, then acting to further advance said piston beyond the stop point to eject the crushed pouch from the barrel.

2. A gun as set forth in claim 1, wherein said pouch is a generally cylindrical foil pack whose diameter is substantially the same as the internal diameter of the barrel.

3. A gun as set forth in claim 1, further including a second barrel in parallel relation to said barrel to provide a pair of barrels, each loadable with a sealed pouch, one containing one component of a two-component agent, the other pouch containing the other component.

4. A gun as set forth in claim 1, wherein said cutting means is a blade mounted at the rear of the cap across the port.

5. A gun as set forth in claim 1, wherein said cap further includes a stop member to limit further advance of the piston.

6. A gun as set forth in claim 1, wherein said opening means are constituted by at least one projection adapted to penetrate the pouch forced thereagainst by the piston, said projection also functioning as a stop member to limit further advance of the piston.

7. A double-barreled gun adapted to eject a two-component agent whose base resin and hardener components are stored in separate sealed foil packs, said gun comprising:

(a) a pair of coextensive barrels, each having a leading end and a trailing end, to receive the respective foil packs through the leading end of each barrel;

(b) a removable manifold provided with a pair of end caps having ports therein and a cooperating cutting element, said caps fitting the leading ends of the barrels, the ports in said caps being coupled to a common outlet;

(c) a piston slidable in each barrel behind the pack therein, said piston having a rod extending from the trailing end of the barrel; and (d) an operating mechanism coupled to the rods to effect concurrent advance of the pistons, said mechanism including a withdrawable stop member, said gun being operable in an injection mode in which the operating mechanism causes the pistons to advance to force the packs against the cutting elements to slit open the packs, the advancing pistons then acting to extrude the components from the packs into the manifold from which the components pass into the outlet to be discharged therefrom, the stop member in this mode limiting piston advance to a stop point short of the cutting elements, at which point the packs are in a crushed state, said gun being thereafter operable in an ejection mode in which the manifold is removed and the stop member is withdrawn, thereby permitting further advance of the pistons beyond the stop point to eject the crushed packs from the barrels.

8. A double-barreled gun as set forth in claim 7, in which said barrels are supported on a stock piece joined to the trailing ends of the barrels, said stock piece being provided with a grip to be engaged by one hand of an operator of the gun.

9. A double-barreled gun as set forth in claim 8, further including a swing gate for said end caps, said swing gate including a pair of parallel arms pivoted at one end to opposite sides of said stock piece, the other end of the arms being bridged by a gate that when swung down then overlies the caps fitted in the barrels, the caps being removable only when the gate is swung up.

10. A double-barreled gun as set forth in claim 7, wherein said piston rods are bridged at their ends by a cross piece and said cross piece is provided at a position intermediate the piston rods with a nut, and said operating mechanism includes a lead screw extending through said nut, one end of the screw being received in a bearing on said cross piece, the other end having a handle attached thereto, whereby the operator by turning the screw with his other hand causes the piston to advance in the barrels.

11. A double-barreled gun as set forth in claim 10, wherein said lead screw is provided adjacent said bearing with a ratchet wheel, and a spring-loaded pawl which normally engages the teeth of the ratchet wheel, whereby the lead screw is free to turn to advance the pistons, but is prevented from retrograde turning to retract the pistons, and a trigger member coupled to the pawl which when actuated retracts the pawl from the ratchet wheel to permit retrograde turning of the screw.

12. A double-barreled gun as set forth in claim 11, wherein said stop member is associated with said trigger member, whereby when the trigger member is actuated, the stop member is then retracted.

13. A double-barreled gun as set forth in claim 10, in which the handle is a crank handle.

14. A double-barreled gun as set forth in claim 10, wherein said nut is a ball bearing nut whose balls lie within the helical track on said screw.

15. A double-barreled gun as set forth in claim 7, in which said barrels are formed of aluminum.

16. A gun for dispensing a viscous agent stored in a sealed, sausage-like, crushable foil pouch, said gun comprising:

(a) a cylindrical barrel having a leading end and a trailing end, said barrel being loadable with the pouch through the leading end thereof, whereby a front foil portion of the pouch is then adjacent the leading end;

(b) a removable cap fitting the leading end of the barrel to retain the pouch therein, said cap being provided with a port;

(c) foil opening means cooperating with the cap facing the front foil portion of the pouch;

(d) a piston slidable in the barrel behind the pouch and provided with a rod extending from the trailing end of the barrel; and (e) an operating mechanism coupled to said piston rod, said mechanism, when the cap is fitted on the leading end of the barrel, acting to first advance the piston to force the front foil portion of the pouch against the foil opening means to create an opening therein, and to then advance the piston to extrude the agent from the pouch through said cap port, and in doing so to crush the foil pouch until the agent is exhausted therefrom and the foil pouch is then in a crushed state at a position adjacent the leading end of the barrel, from which position it may be ejected after removing the cap, said operating mechanism, after the cap is removed from the front end of the barrel, then acting to further advance the piston to eject the crushed pouch from the barrel.

17. A gun as set forth in claim 16, further including a stock piece joined to the trailing end of the barrel and provided with a grip that is engageable by one hand of an operator of the gun.

18. A gun as set forth in claim 17, wherein said operating mechanism includes a stop member to prevent said further advance of the piston, and said grip is provided with a trigger, which when actuated by a finger of the hand of the operator, retracts said stop member to permit said further advance to eject the crushed pouch from the barrel.

* * * * *